US007694460B2

(12) United States Patent
Tao et al.

(10) Patent No.: US 7,694,460 B2
(45) Date of Patent: Apr. 13, 2010

(54) TUNED WINDOW SASH

(75) Inventors: Dongling Tao, Canton, MI (US); John W. Whitehead, Dearborn, MI (US); Len A. Wolf, Ann Arbor, MI (US)

(73) Assignee: AGC Automotive Americas R & D, Inc., Ypsilanti, MI (US)

( * ) Notice: Subject to any disclaimer, the term of this patent is extended or adjusted under 35 U.S.C. 154(b) by 667 days.

(21) Appl. No.: 10/892,650

(22) Filed: Jul. 16, 2004

(65) Prior Publication Data

US 2006/0010775 A1 Jan. 19, 2006

(51) Int. Cl.
*E05F 11/38* (2006.01)

(52) U.S. Cl. ..... 49/375; 49/374

(58) Field of Classification Search ..... 49/374, 49/375, 376, 377, 351, 227; 181/289, 207, 181/209

See application file for complete search history.

(56) References Cited

U.S. PATENT DOCUMENTS

| | | | | |
|---|---|---|---|---|
| 2,398,852 | A | 4/1946 | Parsons | |
| 2,565,232 | A | 8/1951 | Hezler, Jr. | |
| 3,252,256 | A | 5/1966 | Sprecher | |
| 3,754,353 | A | 8/1973 | Breitschwerdt et al. | |
| 3,976,269 | A | 8/1976 | Gupta | |
| 4,452,334 | A | 6/1984 | Rogers | |
| 4,480,417 | A | 11/1984 | Evers | |
| 4,514,714 | A * | 4/1985 | Kanoi et al. | 181/208 |
| 4,600,194 | A | 7/1986 | Donnelly | |
| 4,706,788 | A | 11/1987 | Inman et al. | |
| 4,799,631 | A * | 1/1989 | Humphries et al. | 181/207 |
| 4,944,984 | A | 7/1990 | Kunert | |
| 4,987,699 | A | 1/1991 | Gold | |
| 5,050,348 | A | 9/1991 | Kane et al. | |
| 5,221,988 | A | 6/1993 | Juhasz | |
| 5,340,654 | A * | 8/1994 | Ueda et al. | 427/437 |
| 5,373,922 | A | 12/1994 | Marra | |
| 5,884,892 | A | 3/1999 | Gassen et al. | |
| 5,887,829 | A | 3/1999 | Wong et al. | |
| 5,942,736 | A * | 8/1999 | Cortonesi | 181/289 |

(Continued)

FOREIGN PATENT DOCUMENTS

| | | |
|---|---|---|
| JP | 05-231470 | 9/1993 |
| JP | 2002321526 | 11/2002 |

OTHER PUBLICATIONS

Beranek, L.L.; Istvan, I.L., *Noise and Vibration Control Engineering: Principles and Applications*, 1992, 463-465, John Wiley & Sons, Inc., USA.

(Continued)

*Primary Examiner*—Gregory J. Strimbu
(74) *Attorney, Agent, or Firm*—Frost Brown Todd LLC

(57) ABSTRACT

A window pane having a window sash attached thereto to reduce noise transmitted through the window pane. The window sash comprising a bracket and tuned mass damper attached to the bracket at one or more spaced intervals. The one or more spaced intervals are adjusted to tune the window sash to a targeted frequency to reduce the noise transmitted through the window pane. The targeted frequency may be the coincidence frequency of the window pane. The stiffness and/or mass of the bracket and tuned mass damper can also be chosen to reduce the noise transmitted through the window pane.

5 Claims, 10 Drawing Sheets

U.S. PATENT DOCUMENTS

| | | | | |
|---|---|---|---|---|
| 5,984,233 | A | 11/1999 | Snyder, Jr. et al. | |
| 6,052,947 | A * | 4/2000 | Smith | 49/352 |
| 6,119,404 | A * | 9/2000 | Bschorr et al. | 49/498.1 |
| 6,119,807 | A * | 9/2000 | Benson et al. | 181/208 |
| 6,279,679 | B1 | 8/2001 | Thomasen | |
| 6,463,787 | B1 | 10/2002 | Schumacher et al. | |
| 6,629,614 | B2 | 10/2003 | Jordan | |
| 2002/0030315 | A1 | 3/2002 | Kato et al. | |
| 2002/0113351 | A1 | 8/2002 | Kato et al. | |
| 2004/0074712 | A1 | 4/2004 | Quaglia et al. | |

OTHER PUBLICATIONS

Norton, M.P., *Fundamentals of Noise and Vibration Analysis for Engineers*, 1989, 175-176, Cambridge University Press, USA.

Fahy, F., *Sound and Structural Vibration: Radiation, Transmission and Response*, 1985, 152-154, Academic Press, USA.

Blackstock, D.T., *Fundamentals of Physical Acoustics*, 2000, 203-204, John Wiley & Sons, Inc., USA.

* cited by examiner

TUNED WINDOW SASH

BACKGROUND OF THE INVENTION

There are many aspects to noise control. Noise control may involve the use of a variety of materials and techniques. Specific frequencies or frequency ranges may be selectively targeted for noise reduction. The present invention pertains to a window sash that can be tuned. More particularly, the invention pertains to a window sash, comprising a bracket, that can be tuned to reduce noise transmitted through a window pane at a specific frequency.

SUMMARY

A window assembly comprises a window pane, and a window sash, wherein the window sash comprises a bracket and one or more stiffeners coupled to the bracket at one or more spaced intervals, wherein the one or more spaced intervals each has a length. The window sash is tuned to a coincidence frequency of the window pane by respectively choosing the length of the one or more spaced intervals, wherein the coincidence frequency has a wavelength, wherein the length of the one or more spaced intervals is respectively equal to a multiple of the wavelength of the coincidence frequency.

A window sash for mounting a window pane comprises a bracket and one or more stiffeners coupled with the bracket at one or more attachment points. The one or more attachment points are respectively separated by spaced intervals, wherein the spaced intervals each respectively have a length. The window sash is tuned to a coincidence frequency of the window pane by having the lengths of the one or more spaced intervals respectively equal a multiple of a flexural wavelength of the coincidence frequency for the window pane.

DETAILED DESCRIPTION OF THE INVENTION

Figure 1:
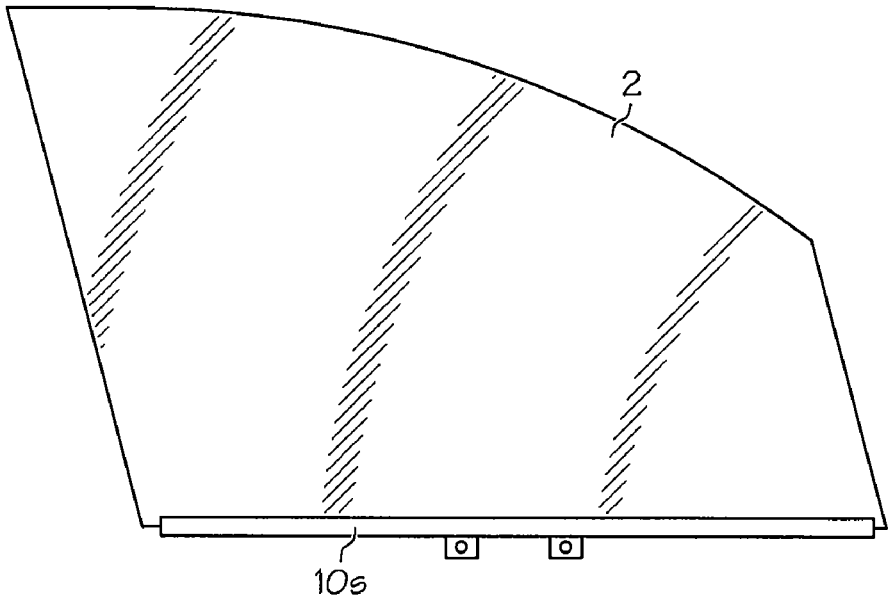
FIG. 1 (PRIOR ART)
FIG. 1 depicts a window sash attached to a vehicle window pane wherein a window regulator is attached to the window sash.
Figure 2:
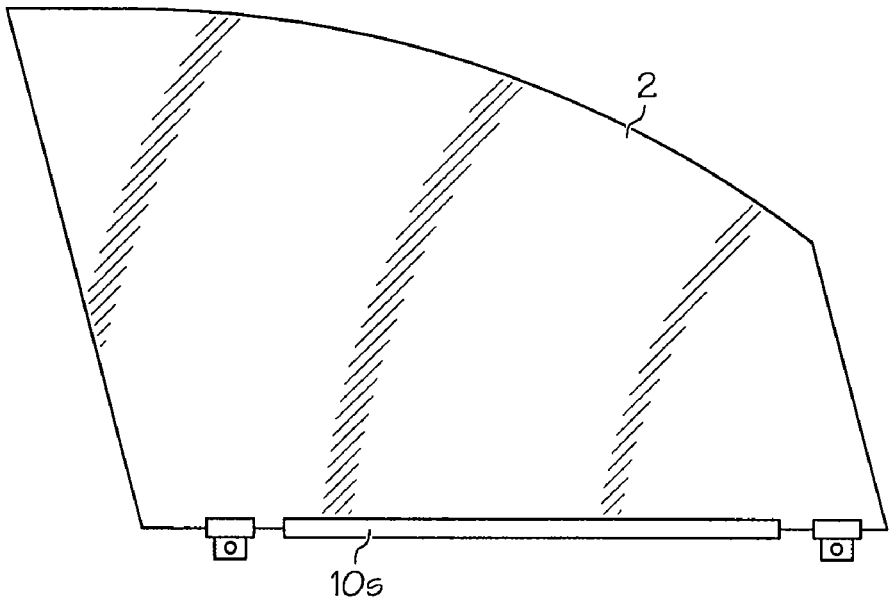
FIG. 2 (PRIOR ART)
FIG. 2 depicts a window sash attached to a vehicle window pane wherein a window sash is separate from a window regulator.

Window sashes are well known in the art. Window sashes are used for mounting one or more window panes to another structure. For example, window sashes may be used to mount windows into vehicle doors. Window sashes typically have a bracket with a U-shaped, or similar, cross-section for receiving an edge portion of a window pane. The window sash 10*s* may be of a configuration capable of mounting a window pane 2 to a window regulating mechanism, as shown in FIG. 1. The window sash may also be comprised of one or more window sash portions disposed along the length of a window pane. When used in a vehicle, the window sash may be attached to a bottom edge of a window pane and may or may not be attached to a window regulating mechanism that causes the window to open and to close. See FIGS. 1 and 2.

Referring now to the window sash of the present invention, the window sash comprises a bracket that can be tuned, i.e., a tunable bracket. It may further comprise a stiffener that can be tuned, i.e., a tunable stiffener. As used in this disclosure, "tuning" or "tuned" means adjusting the interval spacing of the window sash; the stiffness of the bracket, stiffener, and/or window sash; the mass of the bracket, stiffener, and/or window sash; or any combination of the interval spacing, the stiffness of the bracket, stiffener, and/or window sash, and the mass of the bracket, stiffener, and/or window sash for the purpose of reducing noise through a window pane and often, but not necessarily, for the purpose of reducing noise through the window pane at a targeted frequency. The targeted frequency may be the coincidence frequency of the window pane. The coincidence frequency of a window pane is the frequency where the glass naturally allows more noise to pass through.

The coincidence frequency of a panel, $f_c$, may be calculated as follows:

$$f_c = \frac{c^2}{\pi t}\sqrt{\frac{3\rho(1-\upsilon^2)}{E}}$$

Where c is the speed of sound in air, t is the thickness of the panel, ρ is the density of the panel material, v is the Poisson's ratio of the panel material, and E is the Young's modulus of the panel material.

The flexural wavelength, λ, of a panel at its coincidence frequency may be calculated as follows:

$$\lambda = \sqrt[4]{\frac{\pi^2 E t^2}{3\rho f_c^2(1-v^2)}}$$

Where E is the Young's modulus of the panel material, t is the thickness of the panel, ρ is the density of the panel material, $f_c$ is the coincidence frequency of the panel, and v is the Poisson's ratio of the panel material.

For use in the present invention, the coincidence frequency can be determined using the above described formulas for the window pane, the window sash, the bracket or the stiffener.

The bracket of the present invention may be any configuration capable of mounting a window pane in a desired structure. The bracket may have any one of a variety of cross-sections, including U-shaped, V-shaped, L-shaped, C-shaped, and the like. The bracket may be tuned by adjusting its stiffness and/or mass, for example by selecting a particular cross-sectional shape, including bracket thickness. The bracket may also have any of a variety of profiles on its inner surfaces. Some examples of the variation possible among bracket cross-sections and the inner surfaces of the bracket are provided in the various figures included herewith. Additionally, the bracket's cross-section, thickness, and inner surface profile may vary along its length.

The bracket can also be tuned by choosing a material of a particular rigidity and/or density. The bracket may be comprised of any sufficiently rigid material, including metal, such as steel or aluminum; plastic, such as polyvinyl chloride (PVC), nylon, ultra-high molecular weight polyethylene (UHMW), or other rigid plastics; composite materials, such as fiberglass or carbon fiber/epoxy; combinations thereof; and the like. The bracket may be manufactured using any methods known in the art, including but not limited to, molding, extruding, casting, stamping, forming, and machining.

The bracket may further comprise a window pane-receiving sleeve, which fits between the window pane and the inner surface of the bracket. Such sleeves are well-known in the art. They are typically made of a rubber or elastomeric material. The sleeve may be made of any materials known in the art for use as a window pane-receiving sleeve. The inner surface of the sleeve, which contacts the glass surface, comprises the inner surface of the bracket.

The window sash may further comprise a stiffener coupled to the bracket. The stiffener may have one or more suitable cross-sections, including, but not limited to, rectangular, square, circular, semi-circular, triangular, trapezoidal, or u-shaped cross-sections. The stiffener may be substantially solid, substantially hollow, or some combination thereof. The stiffener may be made of any sufficiently rigid material, including metal, such as steel or aluminum; plastic, such as polyvinyl chloride, nylon, ultra-high molecular weight polyethylene, or other rigid plastics; composite materials, such as fiberglass or carbon fiber/epoxy; combinations thereof, and the like. The stiffener may be manufactured using any of a variety of manufacturing processes such as molding, extruding, casting, machining, forming, stamping, or the like. The stiffener can be tuned by choosing a material of a particular stiffness and/or density. The stiffener may also be tuned by adjusting its stiffness and/or mass by selecting a particular thickness, cross-section, or construction. The stiffener may or may not be comprised of the same material as the bracket.

The window sash may be tuned by coupling the stiffener to the bracket at spaced intervals. The window sash may likewise be tuned by removing material from the bracket at spaced intervals. In either instance, the interval spacing can be chosen to tune the bracket to a specific frequency. The spaced intervals along the bracket may each be equal in length. Moreover, the spaced intervals may be equal to a multiple of the wavelength (e.g., half the wavelength, 1× the wavelength, 2× the wavelength) of the frequency of noise through the window pane targeted for reduction. The spaced intervals may be equal to a multiple of the wavelength of the coincidence frequency of the window pane.

In one embodiment of the invention, the window sash 10 is comprised of a bracket 12 and stiffener 14 as shown in FIG. 3-6. The stiffener 14 is comprised of one or more bars that are manufactured, in part or in whole, separately from the bracket 12. The stiffener 14 is then coupled to the bracket 12 by techniques known in the art including, but not limited to, tack welds, spot welds, ultrasonic welds, rivets, bolts, screws, clips, adhesives or any manner suitable for coupling similar or dissimilar materials.

Figure 3:
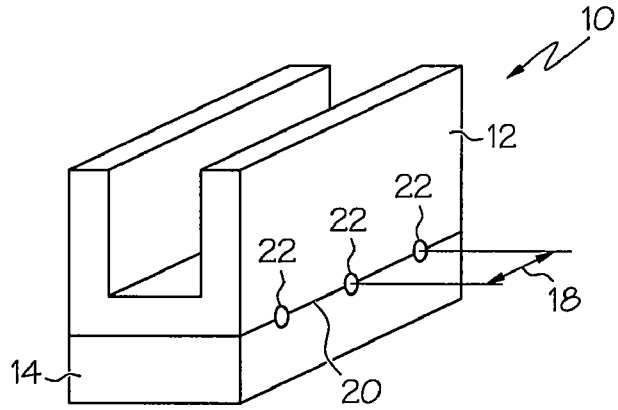
FIG. 3 depicts an isometric view of a bracket of a window sash having a stiffener with side attachment points.

As shown in FIG. 3, the window sash 10 comprises a bracket 12 with a stiffener 14 comprising a single rectangular bar coupled to a lower edge portion 20 of bracket 12 at side attachment points 22, located at the outer edge of the bottom of the bracket 12 and the stiffener 14. The stiffener 14 can be substantially solid, substantially hollow, or some combination thereof. The stiffener 14 may extend substantially the length of the bracket 12, which may extend substantially the length of a window pane. The stiffener 14 may be separated into several smaller sections positioned along the length of the bracket. The stiffener 14 may or may not be comprised of the same material as the bracket 12.

The stiffener 14 may be coupled to the lower edge portion 20 of the bracket 12 at spaced intervals 18 by tack welds, spot welds, ultrasonic welds, rivets, bolts, screws, clips, adhesives or any manner suitable for coupling similar or dissimilar materials. The spaced intervals 18 can be chosen so as to tune the window sash 10. The spaced intervals 18 may each be equal in length. Moreover, the spaced intervals 18 may be equal to a multiple of the wavelength of the frequency of noise through the window pane targeted for reduction. The spaced intervals 18 may be equal to the wavelength of the coincidence frequency of the window pane.

The window sash 10 may also be tuned by adjusting the material or configuration of the stiffener 14, the material or configuration of the bracket 12, and/or the method of attachment of the stiffener 14 to the bracket 12. In addition, the window sash 10 may be tuned by any combination of adjusting the attachment intervals 18; selecting the method of attaching the stiffener 14 to the bracket 12; selecting the material or configuration of the stiffener 14; and/or selecting the material or configuration of the bracket 12.

Figure 4:
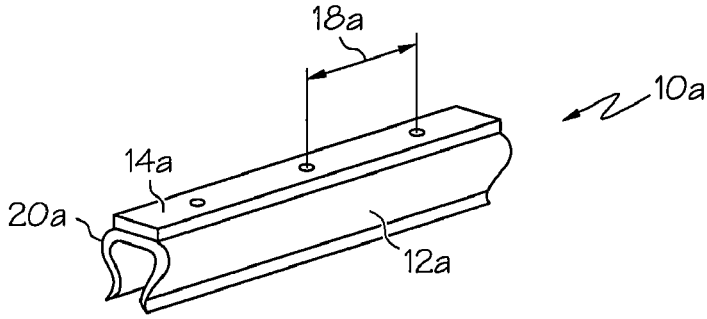
FIG. 4 depicts an isometric view of a bracket of a window sash having a stiffener with center attachment points.

In another embodiment of the invention, the window sash 10*a* comprises a bracket 12*a* and a stiffener 14*a*, as shown in FIG. 4. The stiffener 14*a* comprises a single bar coupled to bracket 12*a* at central points along the stiffener 14*a*. The stiffener 14*a* has a rectangular cross-section. The stiffener 14*a* may be substantially solid, substantially hollow, or some combination thereof. The stiffener 14*a* may extend substantially the length of the bracket, which may extend substantially the length of the window pane. The stiffener 14*a* may be separated into several smaller sections positioned along the length of the bracket 12*a*. The stiffener 14*a* may or may not be comprised of the same material as the bracket 12*a*.

The stiffener 14*a* may be coupled to the central region of the lower edge portion 20*a* of the bracket 12*a* at spaced intervals 18*a* by tack welds, spot welds, ultrasonic welds, rivets, bolts, screws, clips, adhesives or any manner suitable for coupling similar or dissimilar materials. The spaced intervals 18*a* can be chosen so as to tune the window sash 10*a*. The spaced intervals 18*a* may each be equal in length. Moreover, the spaced intervals 18*a* may be equal to a multiple of the wavelength of the frequency of noise through the window pane targeted for reduction. The spaced intervals 18*a* may be equal to the wavelength of the coincidence frequency of the window pane.

The window sash 10*a* may also be tuned by adjusting the material or configuration of the stiffener 14*a*, the material or configuration of the bracket 12*a*, and/or the method of attachment of the stiffener 14*a* to the bracket 12*a*. The window sash 10*a* may also be tuned by any combination of adjusting the attachment intervals 18*a*; selecting the method of attaching the stiffener 14*a* to the bracket 12*a*; selecting the material or configuration of the stiffener 14*a*; and/or selecting the material or configuration of the bracket 12*a*.

Figure 5:
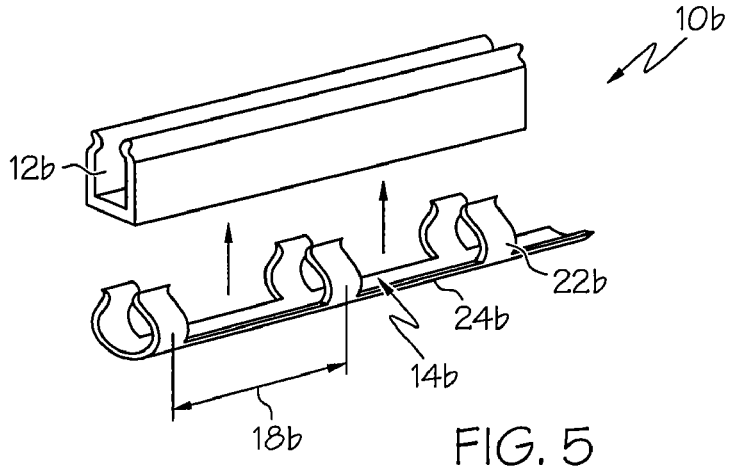
FIG. 5 depicts an isometric view of a bracket of a window sash having a stiffener.

In another embodiment of the invention, the window sash 10*b* comprises a bracket 12*b* and one or more stiffeners 14*b*, as shown in FIG. 5. The stiffener 14*b* comprises a bar section 24*b* with one or more fingers 22*b* that extend from the bar section 24*b*. The stiffener 14*b* may extend substantially the length of the bracket 12*b*, which may extend substantially the length of the window pane. The stiffener 14*b* may be separated into several smaller sections positioned along the length of the bracket 12*b*. The stiffener 14*b* may or may not be comprised of the same material as the bracket 12*b*.

The fingers 22*b* couple the stiffener 14*b* to the bracket 12*b* at spaced intervals 18*b*. The spaced intervals 18*b* can be chosen so as to tune the window sash 10*b*. The spaced intervals 18*b* may each be equal in length. Moreover, the spaced intervals 18*b* may be equal to a multiple of the wavelength of the frequency of noise through the window pane targeted for reduction. The spaced intervals 18*b* may be equal to the wavelength of the coincidence frequency of the window pane.

The fingers 22*b* may be spring clips that clamp around the bracket 12*b*. Alternatively, the fingers 22*b* may be attached to the bracket by means of tack welds, spot welds, ultrasonic welds, rivets, bolts, screws, clips, adhesives, or any manner suitable for coupling similar or dissimilar materials. One or more stiffeners 14*b* may be coupled to bracket 12*b*. The stiffener 14*b* may extend substantially the length of the window pane, or it may extend only a portion of length of the window pane. The length of stiffener 14*b* may be coextensive with the length of bracket 12*b*, or one or more shorter stiffeners 14*b* may be used in conjunction with a longer bracket 12*b*.

The window sash 10*b* may also be tuned by adjusting the material or configuration of the stiffener 14*b*, the material of the bracket 12*b*, and the method of attachment of the stiffener 14*b* to the bracket 12*b*, e.g., spring clips may be less stiff than multiple spot welds. The window sash 10*b* may also be tuned by any combination of adjusting the attachment intervals 18*b*; selecting the method of attaching the stiffener 14*b* to the bracket 12*b*; selecting the configuration or material of the stiffener 14*b*; and/or selecting the material of the bracket 12*b*.

Figure 6:
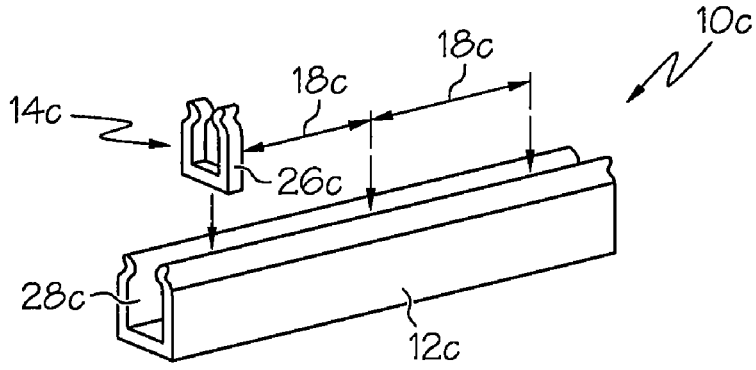
FIG. 6 depicts an isometric view of a bracket of a window sash having separated pieces of rubber liner.

In another embodiment of the invention, the window sash 10*c* comprises a bracket 12*c* and stiffener 14*c*, as shown in FIG. 6. The stiffener 14*c* comprises at least two inserts 26*c* configured to fit within the inside portion 28*c* of the bracket 12*c*.

The at least two inserts 26*c* may be placed within the inside portion 28*c* of the bracket 12*c* at spaced intervals 18*c*. The spaced intervals 18*c* may be chosen to tune the window sash 10*c*. The spaced intervals 18*c* may each be equal in length. Moreover, the spaced intervals 18*c* may be equal to a multiple of the wavelength of the frequency of noise through the window pane targeted for reduction and may be equal to the wavelength of the coincidence frequency of the window pane.

The length of the at least two inserts 26*c* may extend substantially all or some portion of the length of bracket 12*c*, which itself may extend all or some portion of the length of the window pane. The inserts 26*c* may be spaced along substantially all or some portion of the length of the bracket 12*c*. They may or may not be comprised of the same material as the bracket 12*c*.

The window sash 10*c* may also be tuned by adjusting the material or configuration of the inserts 26, the material or configuration of the bracket 12*c*, and the method of attachment of the inserts 26 to the bracket 12*c*, e.g., the inserts 26 may be snapped into place within bracket 12*c* or they may be welded or bonded into place. The window sash 10*c* may also be tuned by any combination of adjusting the attachment intervals 18*c*; selecting the method of attaching the inserts 26 to the bracket 12*c*; selecting the number, length and configuration of the inserts 26; selecting the material or configuration of the inserts 26; and/or selecting the material or configuration of the bracket 12*c*.

Figure 7:
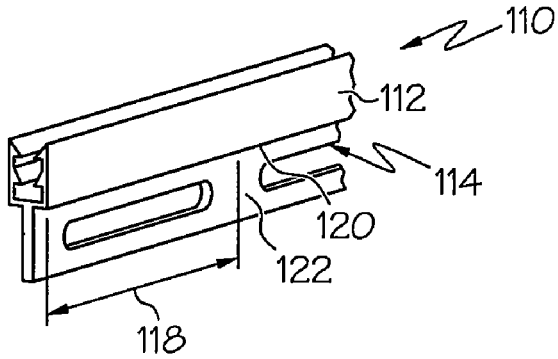
FIG. 7 depicts an isometric view of a bracket of a window sash having a stiffener.
Figure 7A:
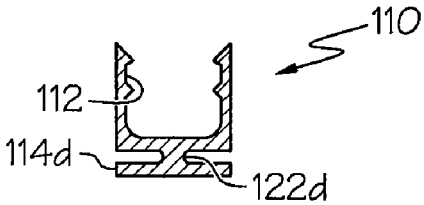
FIG. 7*a* depicts a cross-sectional view of a window sash.
Figure 8:
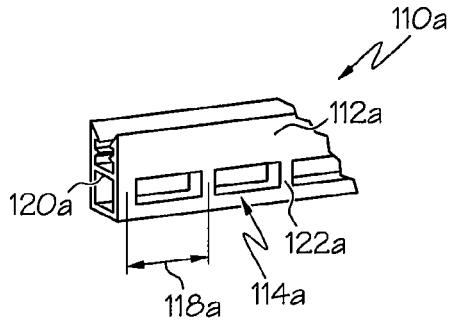
FIG. 8 depicts an isometric view of a bracket of a window sash having a stiffener.

In another embodiment of the invention, the window sash 110, 110*a* comprises a bracket 112, 112*a* and one or more stiffeners 114, 114*a*, 114*d* as shown in FIG. 7-10. The window sash 110, 110*a* can be manufactured such that the bracket 112, 112*a* and one or more stiffeners 114, 114*a*, 114*d* are manufactured as a unitary piece. As shown in FIGS. 7, 7*a*, and 8, the one or more stiffeners 114, 114*a* 114*d* may comprise a bar extending from the bracket 112, 112*a*. One or more pillars 122, 122*a*, 122*d* extend from the underside 120, 120*a* of the bracket 112, 112*a* to the lower edge of the stiffener 114, 114*a*, 114*d*. The pillars 122, 122*a*, 122*d* couple the stiffener 114, 114*a*, 114*d* to the bracket 112, 112*a* at spaced intervals 118, 118*a* where the interval 118, 118*a* extends from centerline to centerline of pillar 122, 122*a*, 122*d*. The spaced intervals 118, 118*a* may be produced as part of an initial manufacturing process, such as a molding process, or may be produced in a subsequent operation by removal of material from the window sash 110, 110*a*, such as by machining or drilling.

The spaced intervals 118, 118*a* can be selected to tune the window sash 110, 110*a*. The spaced intervals 118, 118*a* may each be equal in length. Moreover, the spaced intervals 118, 118*a* may be equal to the wavelength of the frequency of noise through the window pane targeted for reduction and may be equal to the wavelength of the coincidence frequency of the window pane.

The stiffener(s) 114, 114*a*, 114*d* may or may not extend substantially the length of the bracket 112, 112*a*. The stiffener(s) 114, 114*a*, 114*d* may have any cross-section, including rectangular, square, circular, semi-circular, triangular, trapezoidal, u-shaped and the like. The stiffener(s) 114, 114*a*, 114*d* may be substantially solid (as shown in FIG. 7, 7*a*), substantially hollow (as shown in FIG. 8), or some combination thereof. The bracket 112, 112*a* and stiffener(s) 114,

114*a*, 114*d* can be manufactured as a unitary piece through a variety of manufacturing processes such as molding, extruding, casting, and the like.

The window sash 110, 110*a* may also be tuned by adjusting the stiffness and/or mass of the window sash, bracket, and/or stiffener by adjusting the material comprising bracket 112, 112*a* and stiffener(s) 114, 114*a*, 114*d*, and/or the configuration of the stiffener(s) 114, 114*a*, 114*d* and/or bracket 112, 112*a*. The window sash 110, 110*a* may also be tuned by any combination of adjusting the attachment intervals 118, 118*a*; selecting the configuration of the stiffener(s) 114, 114*a*, 114*d* and/or bracket 112, 112*a*; and/or selecting the material of the stiffener 114, 114*a*, 114*d* and bracket 112, 112*a*.

Figure 9:
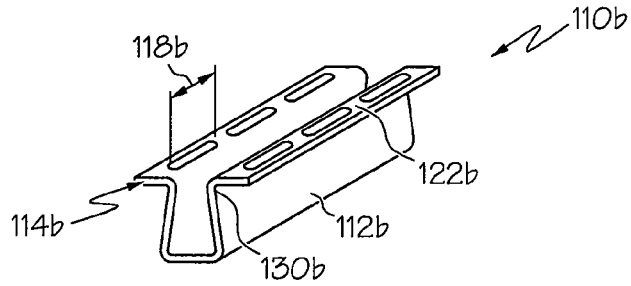
FIG. 9 depicts an isometric view of a bracket of a window sash having a stiffener.
Figure 10:
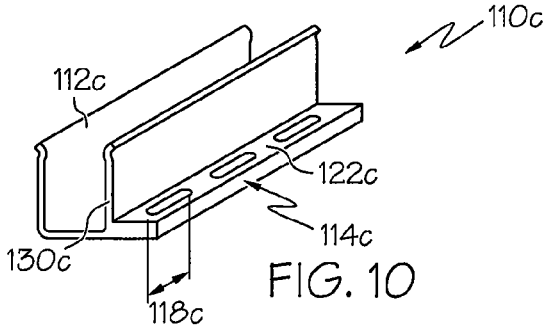
FIG. 10 depicts an isometric view of a bracket of a window sash having a stiffener.
Figure 10A:
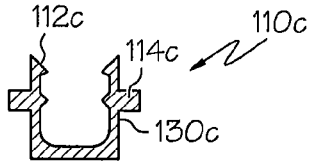
FIG. 10*a* depicts a cross-sectional view of a bracket of a window sash having a stiffener.

In another embodiment of the invention, the window sash 110*b*, 110*c* comprises a bracket 112*b*, 112*c* and one or more stiffeners 114*b*, 114*c*, as shown in FIGS. 9, 10, and 10*a*. The window sash 110*b*, 110*c* is manufactured such that the bracket 112*b*, 112*c* and one or more stiffeners 114*b*, 114*c* are manufactured as a unitary piece. The one or more stiffeners 114*b*, 114*c* are coupled to one or more side portions 130*b*, 130*c* of the bracket 112*b*, 112*c*. One or more pillars 122*b*, 122*c* extend from the side portion(s) 130*b*, 130*c* of the bracket 112*b*, 112*c* to the outer edge of the stiffener 114*b*, 114*c*. The pillars 122*b*, 122*c* couple the stiffener 114*b*, 114*c* to the bracket 112*b*, 112*c* at spaced intervals 118*b*, 118*c* where the interval 118*b*, 118*c* extends from centerline to centerline of pillar 122*b*, 122*c*. The spaced intervals 118*b*, 118*c* may be produced as part of an initial manufacturing process, such as a molding process, or may be produced in a subsequent operation by removal of material, such as by machining or drilling.

The spaced intervals 118*b*, 118*c* can be selected to tune the window sash 112*b*, 112*c*. The spaced intervals 118*b*, 118*c* may each be equal in length. Moreover, the spaced intervals 118*b*, 118*c* may be equal to a multiple of the wavelength of the frequency of noise through the window pane targeted for reduction and may be equal to the wavelength of the coincidence frequency of the window pane.

The stiffener(s) 114*b*, 114*c* may or may not extend substantially the length of the bracket 112*b*, 112*c*. The stiffener(s) 114*b*, 114*c* may have any suitable cross-section, including rectangular, square, circular, semi-circular, triangular, trapezoidal, u-shaped and the like. The stiffener(s) 114*b*, 114*c* may be substantially solid, substantially hollow, or some combination thereof. The bracket 112*b*, 112*c* and stiffener(s) 114*b*, 114*c* are manufactured as a unitary piece through a variety of manufacturing processes such as molding, extruding, casting, forming, stamping, machining, and the like.

The window sash 110*b*, 110*c* may also be tuned by adjusting the stiffness and/or mass of the bracket and/or stiffener by adjusting the material comprising bracket 112*b*, 112*c* and stiffener(s) 114*b*, 114*c*, and/or the configuration of the stiffener(s) 114*b*, 114*c* and/or bracket 112*b*, 112*c*. The window sash may also be tuned by any combination of adjusting the attachment intervals 118*b*, 118*c*; selecting the configuration of the stiffener(s) 114*b*, 114*c* and/or bracket 112*b*, 112*c*; and/or selecting the material of the stiffener 114*b*, 114*c* and bracket 112*b*, 112*c*.

Figure 11:
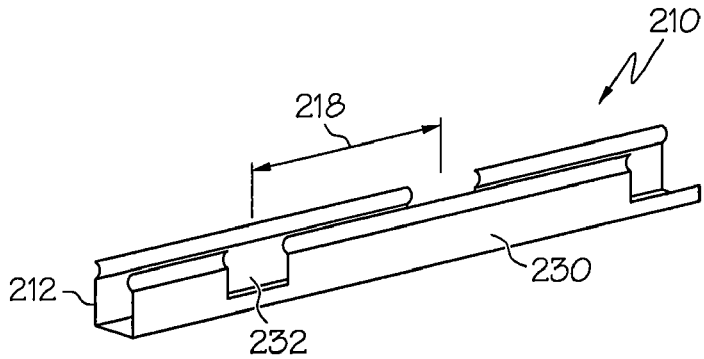
FIG. 11 depicts an isometric view of a bracket of a window sash having cut-out sections.
Figure 12:
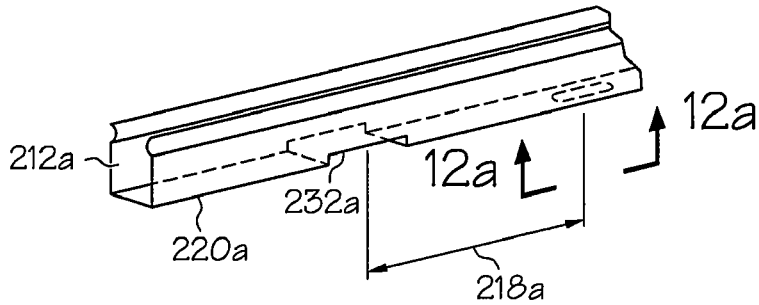
FIG. 12 depicts an isometric view of a bracket of a window sash having cut-out sections.
Figure 12A:
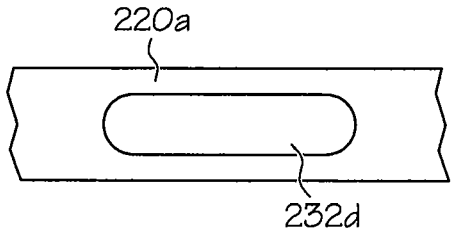
FIG. 12*a* depicts a view of a cut-out section of the window sash of FIG. 12.
Figure 13:
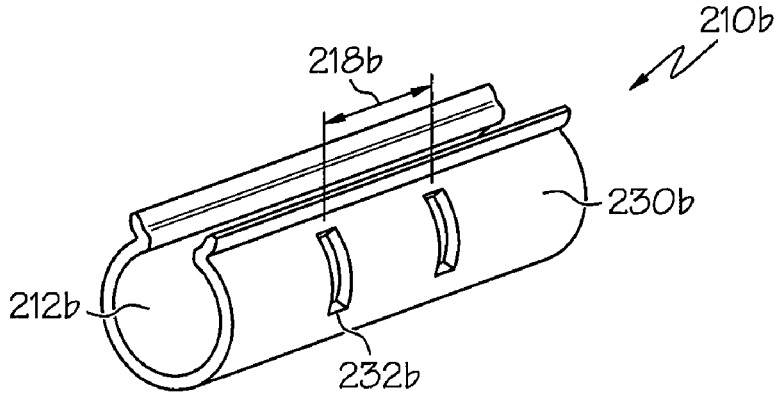
FIG. 13 depicts an isometric view of a bracket of a window sash having cut-out sections.
Figure 13A:
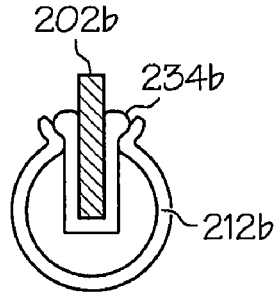
FIG. 13*a* depicts a cross-sectional view of a window sash of FIG. 13.
Figure 14:
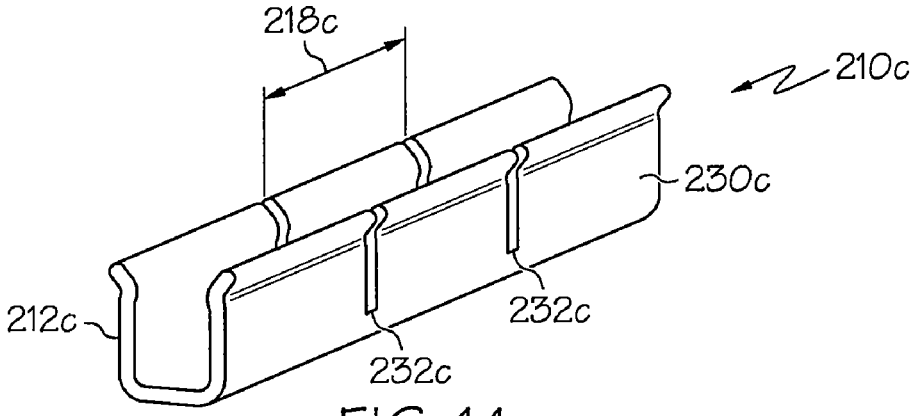
FIG. 14 depicts an isometric view of a bracket of a window sash having cut-out sections.

In other embodiments of the invention, as shown in FIG. 11-14, the window sash 210 may be tuned by removing one or more sections of material from the bracket 212. As shown in FIGS. 11, 12 and 14, one or more cut-out sections 232, 232*a*, 232*c*, 232*d* may be removed from one or more side portions 230, 230*c* (FIG. 11, 14) or bottom portions 220*a* (FIG. 11, 11*b*) of the bracket 212, 212*a*, 212*c*. The cut-out sections 232*a*, 232*b* may be closed, as shown in FIGS. 12 and 13; or they may be open, as shown in FIGS. 11 and 14. The cut-out sections 232, 232*a*, 232*c* 232*d* in FIGS. 11, 12 and 14 may be of any shape, including rectangular, triangular, circular, oval, and the like. The bracket 212, 212*a*, 212*c* may be manufactured such that the cut-out section(s) 232, 232*a*, 232*c*, 232*d* are included in an initial manufacturing process, such as a molding process, or may be removed in a subsequent process, such as by subsequent machining.

The cut-out sections 232, 232*a*, 232*c*, 232*d* may be separated by spaced intervals 218, 218*a*, 218*c*. The spaced intervals 218, 218*a*, 218*c* can be selected to tune the window sash 210, 210*a*, 210*c*. The spaced intervals 218, 218*a*, 218*c* may each be equal in length. The spaced intervals 218, 218*a*, 218*c* may be equal to a multiple of the wavelength of the frequency of noise through the window pane targeted for reduction. They may be equal to the wavelength of the coincidence frequency of the window pane.

The number, size, shape, and spacing of the cut-out section(s) 232, 232*a*, 232*c*, 232*d* can be chosen and adjusted to tune the window sash 210, 210*a*, 210*c*. The bracket 212, 212*a*, 212*c* may also be tuned by adjusting its stiffness and/or mass by selection of the material from which it is made and/or the configuration, including thickness, of the bracket 212, 212*a*, 212*c*.

In an embodiment of the invention shown in FIG. 13, the window sash 210*b* comprises a bracket 212*b* with one or more cut-out sections 232*b* removed from one or more side portions 230*b* of the bracket 212*b*. An edge of window pane 202*b* is contained in one or more sleeves 234*b*. One or more sleeves 234*b* fits within bracket 212*b*. The one or more sleeves 234*b* may extend substantially the length of the bracket 212*b*, which may itself extend substantially the length of the window pane 202*b*. The cut-out sections 232*b* may be of any shape, including rectangular, triangular, circular, oval, and the like. The bracket 212*b* may be manufactured such that the cut-out section(s) 232*b* are included in an initial manufacturing process, such as a molding process, or may be removed in a subsequent process, such as by subsequent machining.

The cut-out sections 232*b* are separated by spaced intervals 218*b*. The window sash 210*b* can be tuned by selection of the spaced intervals 218*b*. The spaced intervals 218*b* may each be equal in length. The spaced intervals 218*b* may be equal to a multiple of the wavelength of the frequency of noise through the window pane targeted for reduction and may be equal to the wavelength of the coincidence frequency of the window pane.

The number, size, shape, and spacing of the cut-out section(s) 232*b* can be chosen and adjusted to tune the window sash 210*b*. The bracket 212*b* may also be tuned by adjusting its stiffness and/or mass by selection of the material from which it is made and/or the configuration, including thickness, of the bracket 212*b*.

Figure 15:
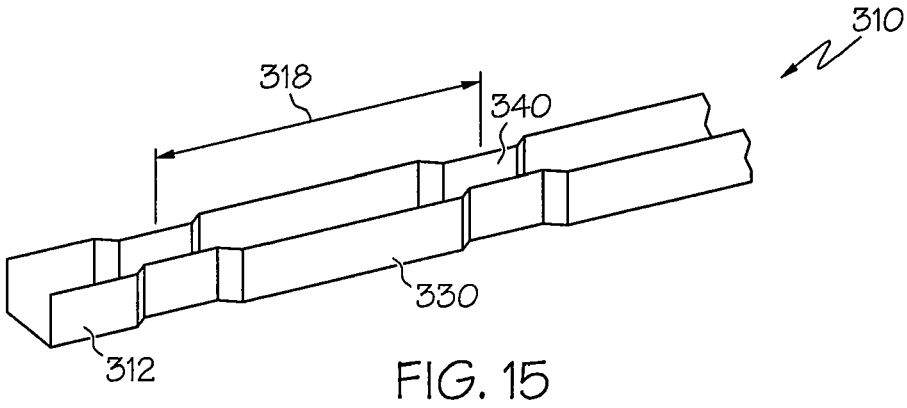
FIG. 15 depicts an isometric view of a bracket of a window sash having a non-uniform cross-section.
Figure 16:
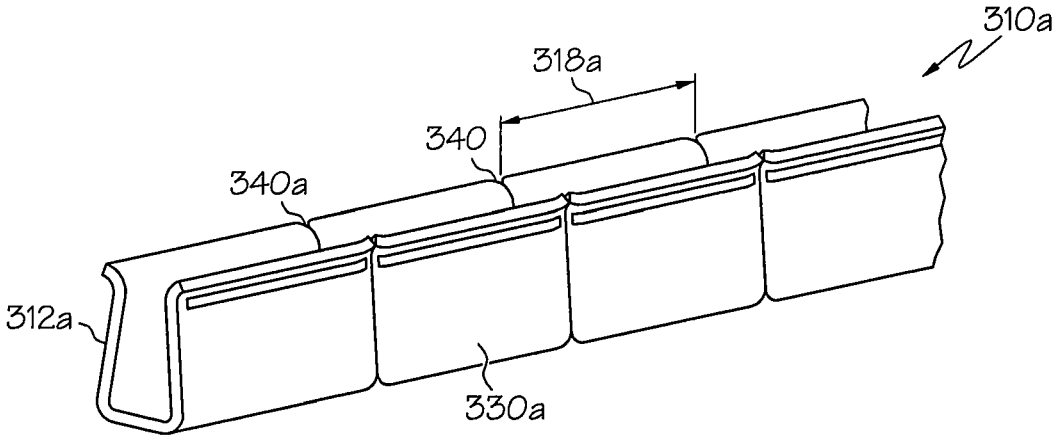
FIG. 16 depicts an isometric view of a bracket of a window sash having a non-uniform cross-section.
Figure 17:
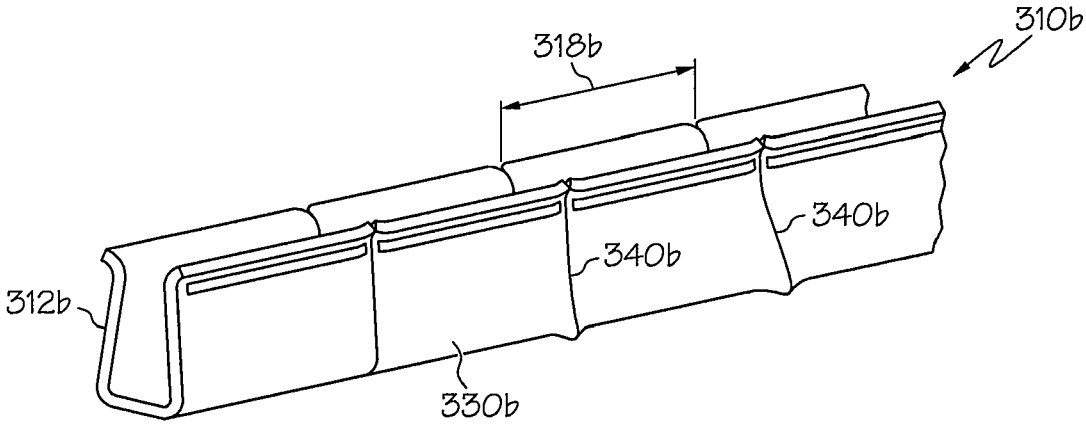
FIG. 17 depicts an isometric view of a bracket of a window sash having a non-uniform cross-section.

In other embodiments of the invention, as shown in FIG. 15-17, the window sash 310, 310*a*, 310*b* comprises a bracket 312, 312*a*, 312*b* that may be tuned by changing the cross-section of the bracket 312, 312*a*, 312*b* so that it is not constant along its length. As shown in FIG. 15-17, one or more ribs 340, 340*a*, 340*b* may be added to at least one sidewall 330, 330*a*, 330*b* of the bracket 312, 312*a*, 312*b*. The rib(s) 340, 340*a*, 340*b* may be of any shape, including rectangular, triangular, circular, oval, trapezoidal, ridged, and the like. The one or more ribs 340, 340*a*, 340*b* may extend substantially the length of the bracket 312, 312*a*, 312*b*, which may itself extend substantially the length of the window pane. Further, the rib(s) 340, 340*a*, 340*b* may be separated by spaced intervals 318, 318*a*, 318*b*.

The spaced intervals 318, 318*a*, 318*b* may be chosen to tune the window sash 310, 310*a*, 310*b*. Each of the spaced intervals 318, 318*a*, 318*b* may be equal in length. The spaced intervals 318, 318*a*, 318*b* may be equal to a multiple of the wavelength of the frequency of noise through the window pane targeted for reduction and may be equal to the wavelength of the coincidence frequency of the window pane.

The bracket 312, 312*a*, 312*b* may be manufactured such that the ribs 340, 340*a*, 340*b* are included in an initial manufacturing process, such as a molding process, or may be added or removed in a subsequent process, such as a stamping, crimping or rolling operation. The bracket 312, 312*a*, 312*b* may also be tuned by adjusting its stiffness and/or mass by selection of the material from which it is made and/or its thickness.

Figure 18:
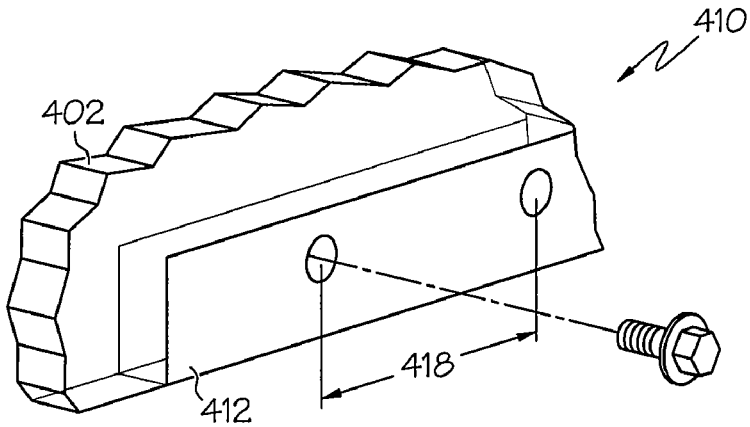
FIG. 18 depicts an isometric view of a bracket of a window sash coupled to a window pane.
Figure 19:
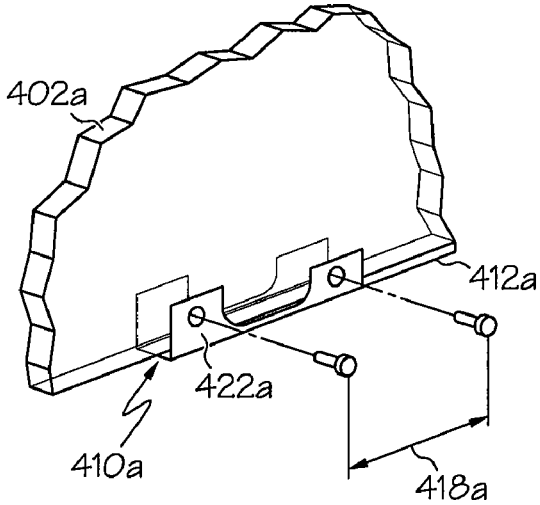
FIG. 19 depicts an window pane isometric view of a bracket of a window sash coupled to a. View of FIG. 20 depicts a side a window sash with a stiffener.

In other embodiments of the invention, as shown in FIG. 18 and FIG. 19, the window sash 410, 410*a* may be tuned by the manner in which the bracket 412, 412*a* is coupled to the window pane 402, 402*a*. As shown in FIG. 18 and FIG. 19, the bracket 410, 410*a* may be coupled to the window pane 402, 402*a* at spaced intervals 418, 418*a*. The spaced intervals 418, 418*a* may be chosen to tune the window sash 410, 410*a*. Each of the spaced intervals 418, 418*a* may be equal in length. The spaced intervals 418, 418*a* may be equal to a multiple of the wavelength of the frequency of noise through the window pane 402, 402*a* targeted for reduction and may be equal to the wavelength of the coincidence frequency of the window pane.

The bracket 412, 412*a* may be coupled to the window pane 402, 402*a* by ultrasonic welds, rivets, bolts, screws, clips, adhesives or any suitable manner for coupling similar or dissimilar materials. In addition, if bolts and the like are employed, the window sash 410, 410*a* may be further tuned by how tightly the bracket 412, 412*a* is coupled to the window pane 402, 402*a*.

Figure 18A:
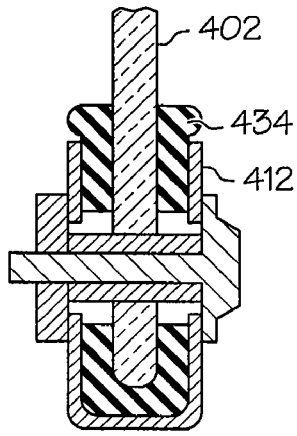
FIG. 18*a* depicts a cross-sectional view of a window sash of FIG. 18.

In addition, as shown in FIG. 18*a*, a sleeve 434 may be disposed between the bracket 412 and the window pane 402. The use of a sleeve 434 and the selection of material for such sleeve 434 may also be used to tune the window sash 410.

The bracket 412, 412*a* may have a constant cross-section as shown in FIG. 18 or it may have flanges 422*a* as shown in FIG. 19. One or more brackets 412, 412*a* may be disposed along the length of the window pane 402, 402*a*, and the one or more brackets 412, 412*a* may be disposed substantially along the entire length of the window pane 402, 402*a*. The bracket 412, 412*a* can be tuned by adjusting its stiffness and/or mass by choosing a material of a particular rigidity or a particular configuration of the bracket 412, 412*a*.

EXAMPLE 1

Figure 20:
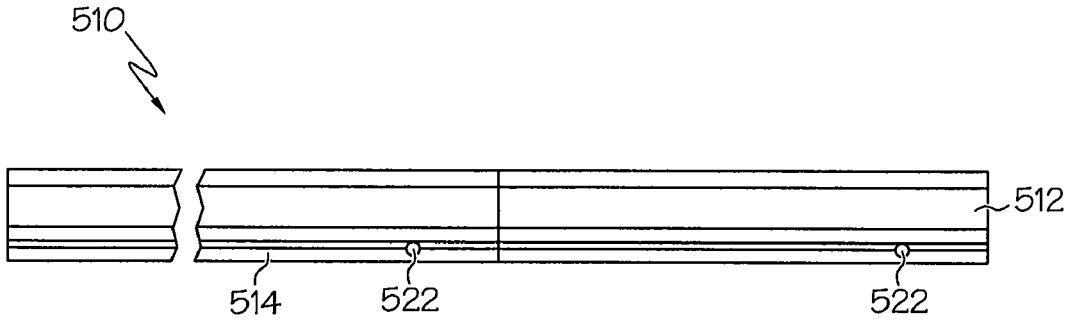
FIG. 20*a* depicts a cross-sectional view of a window sash of FIG. 20.
Figure 20A:
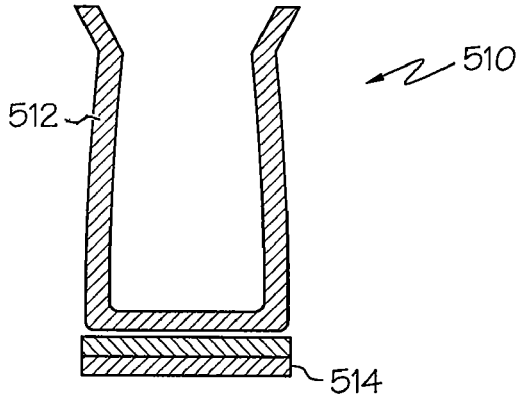

A window sash 510 of the present invention, as shown in FIG. 20, comprises a stiffener 514 with a single rectangular bar stiffener 514 coupled by tack welds to the bottom of bracket 512 at attachment points 522, located at the outer edge of the bottom of the bracket 512 and the stiffener 514. The bracket 512 and stiffener 514 are both made of mild steel. The bracket 512 is formed by a rolling process, while the stiffener 514 is formed by slitting and cutting steel sheet. The bracket 512 has an interior width of 5.4 mm, which is sufficient to hold a 3.8 mm thick pane of glass and also a rubber sleeve between the bracket 512 and the glass. The stiffener 514 is 1.1 mm thick and 8.6 mm wide, which provides the optimum stiffness and mass for the bracket 512. The attachment points 522 are spaced at 110 mm intervals, which is equal to the wavelength of sound in the glass pane at the frequency of coincidence for 3.8 mm glass.

EXAMPLE 2

The window sash of Example with a window pane is installed in a 2003 Infiniti G35 right front car door as a test fixture. The window sash includes 3.8 mm thick window pane. Attached to the bracket is a 1.1 mm thick stiffener with interval spacing of 110-115 mm. The noise transmission is tested according to SAE standard J1400. The noise source is pink noise, approximately 105 dB level. The transmitted sound is measured by an intensity probe that scans a grid of points over the surface of the glass window pane.

Figure 21:
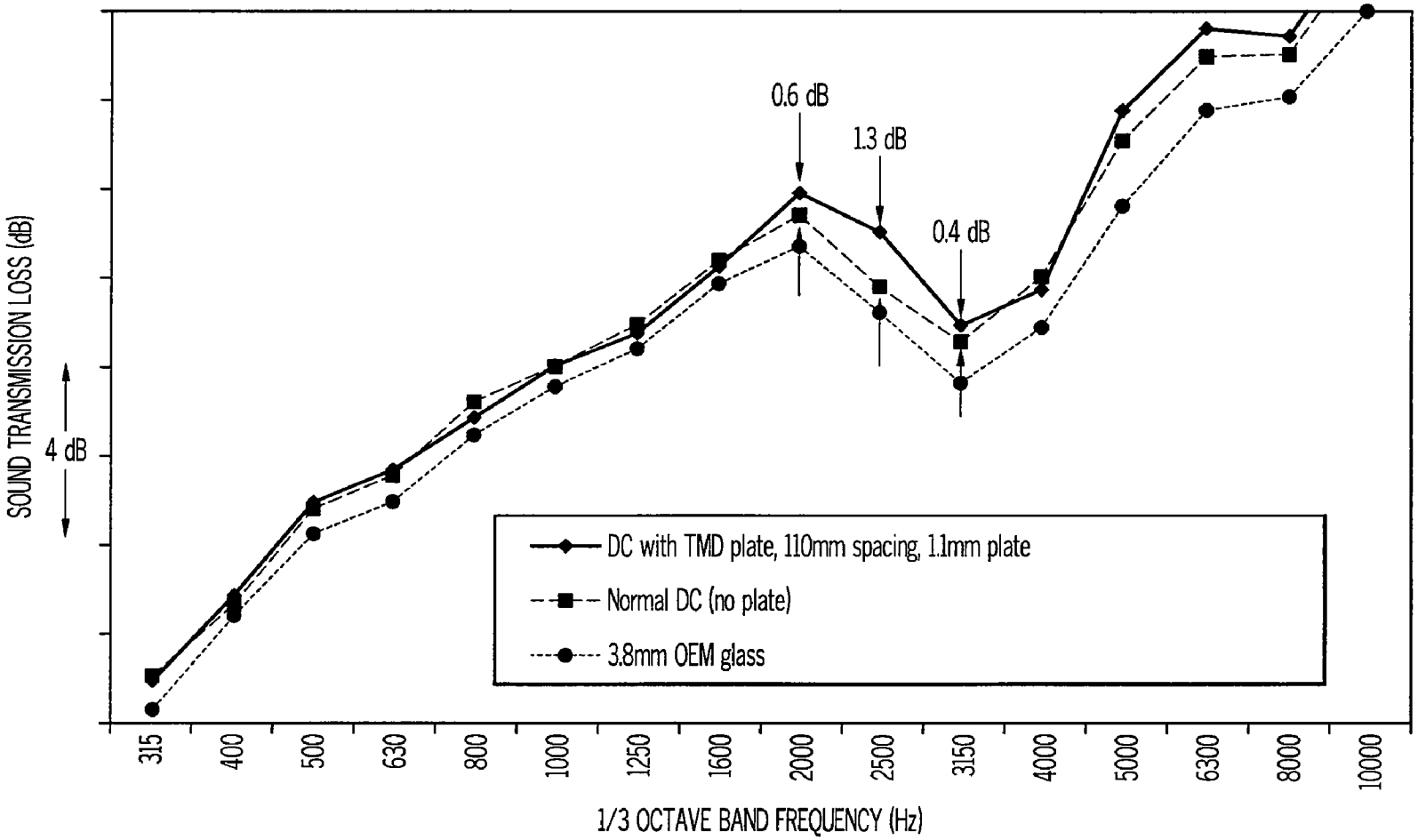
FIG. 21 is a graph depicting the noise transmission loss improvement resulting from a window sash of the present invention.

FIG. 21 shows the comparative sound transmission of the window pane in window sash 510 ("DC with TMD plate", i.e., damping channel with tuned mass damper), a window pane in a prior art damping channel ("Normal DC", i.e., normal damping channel); and 3.8 mm glass window pane with no damping channel at all ("3.8 mm OEM glass"). The window sash is tuned to dampen noise particularly in the 3150 Hz frequency band, which are frequencies most sensitive to the human ear. Compared to the prior art damping channel, the window sash of the present invention lessens the noise by 0.6 dB in the 2000 Hz band, 1.3 dB in the 2500 Hz band, and 0.4 dB in the 3150 Hz band.

Features of various embodiments described herein may be combined so as to tune a window sash as required by a particular application. Having shown and described various embodiments, further adaptations of the methods and systems described herein can be accomplished by appropriate modifications by one of ordinary skill in the art without departing from the scope of the present invention. Several of such potential modifications have been mentioned, and others will be apparent to those skilled in the art. Accordingly, the scope of the present invention should be considered in terms of the following claims and is understood not to be limited to the details of structure and operation shown and described in the specification and drawings.

What is claimed is:

1. A window assembly comprising:

(a) a window pane; and (b) a window sash, wherein the window sash comprises a bracket and one or more stiffeners coupled to the bracket at one or more spaced intervals, wherein each of the one or more spaced intervals has a length;

wherein the window sash is tuned to a coincidence frequency of the window pane wherein the coincidence frequency of the window pane has a wavelength and the length of each of the one or more spaced intervals is equal to a multiple of the wavelength of the coincidence frequency of the window pane.

2. The window assembly of claim 1 wherein the one or more stiffeners are welded to the bracket at the one or more spaced intervals.

3. The window assembly of claim 1 wherein the window sash is tuned by adjusting the stiffness of one of the following: the one or more stiffeners, the bracket, and a combination of both the one or more stiffeners and the bracket.

4. The window assembly of claim 1 wherein the window sash is tuned by adjusting the mass of one of the following: the one or more stiffeners, the bracket, and a combination of both the one or more stiffeners and the bracket.

5. The window assembly of claim 1 wherein the window sash is tuned by (a) adjusting the stiffness of one of the following: the one or more stiffeners, the bracket, and a combination of both the one or more stiffeners and the bracket; and (b) adjusting the mass of one of the following: the one or more stiffeners, the bracket, and a combination of both the one or more stiffeners and the bracket.

* * * * *